US005092386A

United States Patent [19]

Spohr et al.

[11] Patent Number: 5,092,386

[45] Date of Patent: Mar. 3, 1992

[54] SPACER FOR LAMELLA CARRIERS OF VERTICAL LAMELLA BLINDS

[75] Inventors: Horst Spohr, Cuxhaven; Walter Huegin, Efringen-Kirchen, both of Fed. Rep. of Germany

[73] Assignee: bautex Adolf Stoever Soehne KG, Fed. Rep. of Germany

[21] Appl. No.: 387,166

[22] Filed: Jul. 28, 1989

[30] Foreign Application Priority Data

Jul. 29, 1988 [DE] Fed. Rep. of Germany ..... 3825941
Mar. 14, 1989 [DE] Fed. Rep. of Germany ..... 3907043

[51] Int. Cl.[5] ..... E06B 9/30

[52] U.S. Cl. ..... 160/173; 160/178.1; 160/168.1

[58] Field of Search ..... 160/173, 168.1, 178.1, 160/900; 24/16 PB

[56] References Cited

U.S. PATENT DOCUMENTS

| | | | |
|---|---|---|---|
| 4,293,021 | 10/1981 | Arena | 160/900 X |
| 4,418,448 | 12/1983 | Sauer | 24/16 PB X |
| 4,732,202 | 3/1988 | Anderson | 160/900 X |
| 4,791,703 | 12/1988 | Chang | 160/178.1 X |
| 4,813,416 | 3/1989 | Pollack et al. | 24/16 PB X |

*Primary Examiner*—Blair M. Johnson
*Attorney, Agent, or Firm*—Hill, Van Santen, Steadman & Simpson

[57] ABSTRACT

A spacer for lamella carriers of vertical lamella blinds comprises an oblong, strip-shaped section, an end connector element for positive engagement with the lamella carrier, as well as a detent arranged at its free end that can be guided into seating with the neighboring lamella carrier. For simplification of assembly and in order to avoid a spreading of the strip-shaped sections, the connector element of the spacer carriers two channels at its side facing away from the lamella carrier, these two channels being directed toward one another and their spacing and width essentially corresponding to the dimensions of the strip-shaped section of the spacer, so that the strip-shaped section of the spacer of the following lamella carrier is capable of sliding in these channels during extension of retraction. The upper terminating surface of the connector element that faces toward the lamella carrier is inclined relative to the longitudinal axis of the strip-shaped section, so that the strip-shaped sections of all spacers lie tightly on top of one another in imbricated fashion when the lamella carriers are brought together.

13 Claims, 2 Drawing Sheets

SPACER FOR LAMELLA CARRIERS OF VERTICAL LAMELLA BLINDS

BACKGROUND OF THE INVENTION

The invention is directed to a spacer for lamella carriers of vertical lamella blinds composed of an oblong, strip-shaped section having an end connector element for positive engagement with the lamella carrier as well as with a detent arranged at its free end that can be guided into seating with the neighboring lamella carrier.

Vertical blinds generally serve as a sun screen and/or viewing screen as well as, for instance, as room dividers for temporary subdivision or compartmentalization of larger spaces. The vertically arranged lamella that are fashioned strip-shaped and are generally composed of textile material have their upper end secured to a lamella holder or carrier, being generally secured pivotably around a middle longitudinal axis, whereby a simultaneous, common swivelling of all lamella of a vertical blind can usually ensue on the basis of a drive. The lamella carriers are held in a rail and are displaceable along the carrying rail with a manual or motor drive.

In the open position wherein the window or the like is not covered by the lamellae, the lamellae are brought together at one side to form a packet, whereby the lamellae are arranged parallel to one another. When the window or the like is to be completely or only partially covered by the lamellae of the vertical blind, then the displacement drive is actuated. The first lamellae situated at the front is thereby first placed in motion. When the first lamella has achieved the prescribed spacing from the second lamella adjacent to it, then the second lamella begins to move until, finally, all lamellae have been displaced and the window is correspondingly covered. Simultaneously or subsequently, the lamellae can be pivoted around their longitudinal axes with the swivelling drive.

The mutual spacing between two lamellae adjacent to one another in the extended condition is dimensioned such that the edge sections of the lamellae adjacent to one another in the extended condition is dimensioned such that the edge sections of the lamellae adjacent to one another overlap in the closed position in order to prevent light incidence or, viewing from the outside. This mutual spacing between two lamellae adjacent to one another is assured by spacers that are arranged between lamellae carrier adjacent to one another.

In a known spacer, the connector element at the end of the strip-shaped section has its side facing toward the lamella carrier provided with a shoulder that engages into a corresponding profile of the lamella carrier. At its opposite side, the connector element has its edges respectively provided with a superior flange that engages under correspondingly projecting flanges of the lamella carrier in the assembled condition, so that a fixed, positive connection between the spacer and the lamella carrier is effected. The spacer of the neighboring lamella carrier has its strip-shaped section engaging behind the aforementioned flange of the lamella carrier and is guided between the lateral flanges of the connector element of the first spacer.

When the first lamella carrier is extended, the strip-shaped section of the spacer of the second lamella carrier slides through under the aforementioned flanges of the first lamella carrier until the detent at the free end of the spacer is seated against the flanges. Due to this non-positive engagement, the second lamella carrier is guided together with the first at the distance defined by the spacer, whereby the strip-shaped section of the third lamella carrier now slides through under the flanges of the second lamella carrier until the end detent thereof is seated against the flanges, etc. The observation of a uniform spacing is thereby guaranteed with simple means.

During opening, the operations are accomplished in the reverse sequence. After the first lamella carrier has been seated upon insertion of the strip-shaped section of the spacer of the second lamella carrier under the flanges of the first lamella carrier, the second lamella carrier is now displaced in the direction toward the third, whereby the spacer of the latter now slides over the flange of the second lamella carrier. This demonstrates a serious disadvantage of this known spacer. Due to the flange of the preceding lamella carrier onto which the strip-shaped section of the respectively following spacer slides, the latter is spread outward. After being brought together, consequently, the spacers form a cockscomb-like configuration, whereby they lie against the inside profile of the carrying rail and exert a disadvantageously decelerating effect here. A further disadvantage of the known spacers lies therein that the respective connector element of a single spacer must be respectively latched into a lamella carrier, whereupon the individual elements are to be combined to form a group of a lamella carriers. This causes an involved, time-consuming and costly assembly.

In view of this problem, the object of the invention is to fashion a spacer such that a decelerating effect due to spread, strip-shaped sections of the spacers within the carrying rail profile need not be feared, whereas on the other hand, the assembly should be considerably simplified.

This object is inventively achieved by the features recited in the characterizing part of the generic claim, whereby the features of the subclaims are referenced with respect to preferred developments of the spacer of the invention.

These and other objects of this invention will become apparent from the following disclosure and appended claims.

SUMMARY OF THE INVENTION

According to the invention, the connector element of the spacer carries two channels directed toward one another at the side facing away from the lamella carrier, the spacing and width of these channels essentially corresponding to the dimensions of the strip-shaped section of the spacer. The strip-shaped section of the respectively following spacer can now be guided in the channels of the preceding spacer. As a result thereof, a flatter structure is enabled and the disadvantageous spreading is eliminated.

This effect is optimized by the preferred development to the effect that the base area of the connector element lying against the lamella carrier is inclined relative to the longitudinal axis of the stripshaped section. As a result of this predetermined inclination, the strip-shaped sections place themselves against one another to form a compact package when the lamella carriers are brought together. An expedient inclination between the base area and the strip-shaped section lies between about 5° and about 10°, whereby 6° has proven particularly practical.

A further great advantage of the design of the invention is comprised therein that an arbitrary long series of spacers can now be connected to one another, for instance, at the factory. The plurality thereof required for a specific window width is now simply unlatched from this series and is clipped onto the corresponding plurality of lamella carriers in a time-saving fashion.

In accord with an advantageous development, the channels are formed by inwardly directed projections that are arranged at a distance from the base area of the connector element, are essentially triangular in cross section and are held at two lateral longitudinal flanges of the connector element. The inclined lateral surfaces first facilitate the latching of the strip-shaped section of the following spacer, whereas, second, they form a good guidance for the lateral edges of the strip-shaped sections that are chamfered at both sides.

The channels preferably extend only a subregion of the connector element, namely expediently only over the front third. They are adapted to the inclination of the strip-shaped sections.

The lateral, longitudinal clips of the connector element preferably run out toward the back end thereof. Lateral projections in the region of the connector element engage into corresponding slots of the lamella carrier.

In accord with an advantageous development, catch noses for positive engagement with the lamella carriers are provided at that side of the connector element facing toward the lamella carrier. At least one of the catch noses is expediently limited at the outside by a slanting surface, this facilitating the latch-in event. A transverse detent that can extend over the entire width of the connector element is advantageously provided at the back end of the connector element. The transverse detent engages into a corresponding recess of the lamella carrier, so that a disengagement need not be feared even given an intensified pull on the spacers. It has proven particularly advantageous to hold these spacers in a profiled niche at the underside of the lamella carrier. An improved space utilization of the inside profile of the carrying rail thus derives.

Further details, advantages and features essential to the invention derive from the following description of a preferred embodiment of the spacer of the invention with reference to the attached drawings.

DESCRIPTION OF THE PREFERRED EMBODIMENT

Figure 1:
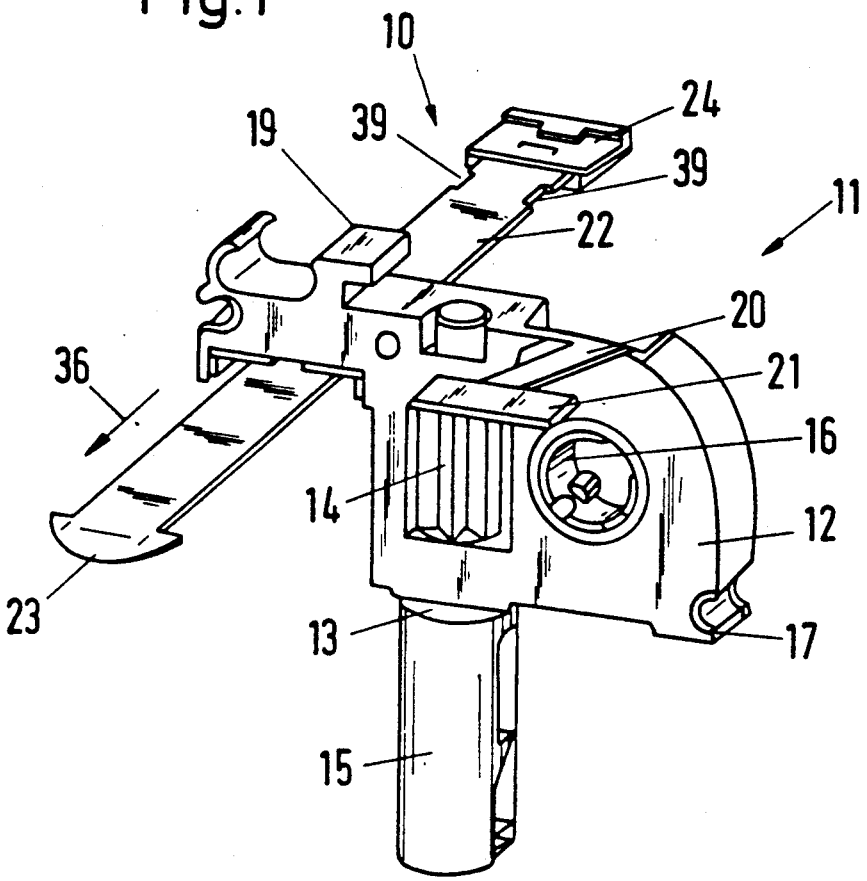
FIG. 1 is a perspective view of a lamella carrier into which the spacer of the invention is latched.

The spacer shown in a perspective view in FIG. 1 and referenced overall with reference numeral 10 is latched into a profiled niche of a lamella carrier referenced 11 overall, being latched thereinto in the illustrated fashion. The lamella carrier shall be explained in brief below with respect to its function. A vertical axis or shaft 13 is seated in the housing 12, this vertical axis or shaft 13 carrying a pinion 14 in its middle region that is executed of the same material as the axis or shaft 13. A lamella mount 15 projects in a downward direction beyond the housing 12. A worm 16 that is manually driven or motor-driven via a shaft is in engagement with the pinion 14. The angular position of the lamella mount 15, and accordingly of the vertical lamella secured thereto and not shown in detail, can be adjusted via a rotation of the worm 16. Hook-shaped glide projects 17, 18 and 19 engage at correspondingly profiled glide surfaces in the cross-sectional region of the carrying rail. A transverse bolt 21 axially offset via a web 20, slides in a profiled niche of the carrying rail and holds the housing in a plane perpendicular to the longitudinal axis of the carrying rail and thus prevents a tilting.

Figure 2:
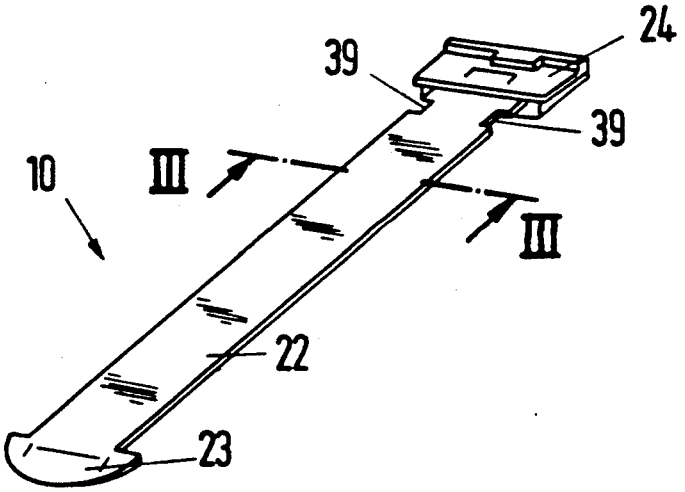
FIG. 2 shows the spacer of FIG. 1 in a discrete view.

The spacer 11 reproduced in FIG. 2 comprises an oblong, strip-shaped section 22, a front detent 23, as well as a fastening element 24 that shall be set forth in yet greater detail below with reference to FIGS. 3 and through 5. Although the spacer can also be composed of metal, it is preferably fabricated of plastic since this is lightweight, cost-beneficial and flexible, whereas it can also be subjected to the desired shaping in a relatively simple way.

Figure 3:
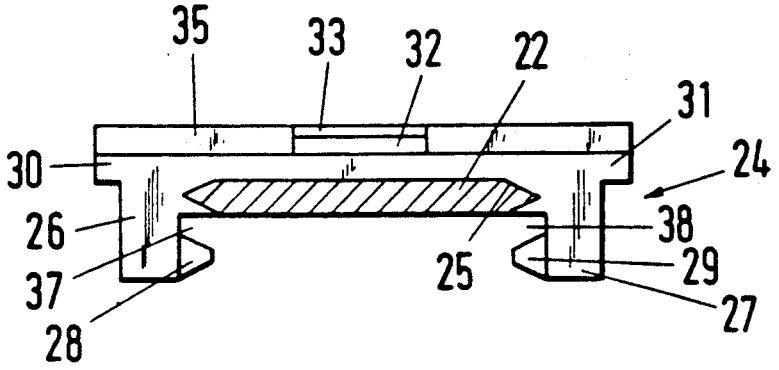
FIG. 3 shows a section through the spacer corresponding to the section line III—III of FIG. 2, shown enlarged.
Figure 4:
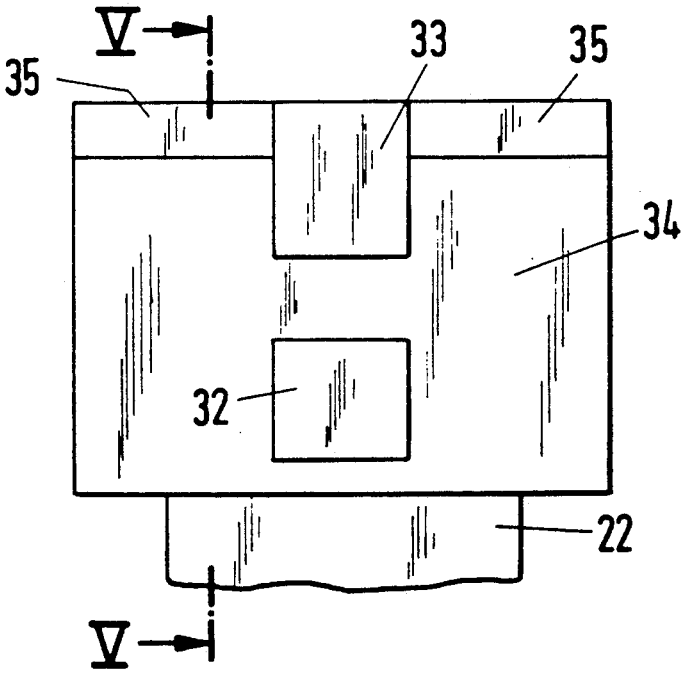
FIG. 4 is a plan view of the connector element of the spacer in the scale corresponding to FIG. 3.

The cross-sectional profile of the fastening element 24 is seen in the illustration of FIG. 3. The strip-shaped section 22 has double-sides chamfers 25 along its longitudinal edges. The section 22 is fabricated of the same material as the detent 23 as well as the fastening element 24. Lateral longitudinal flanges 26 and 27 project from the bottom surface of the fastening element 24; these longitudinal flanges 26 and 27 carrying inwardly directed projections 28 and 29 along their outside edge; and these projections 28 and 29 being essentially triangular in cross section. As may be seen from FIG. 5, the projections 28 and 29 extend only over about the first third of the longitudinal flanges 26 and 27, proceeding from the section 22. The longitudinal flanges 26 and 27 run out toward the back end of the connector element 24.

It also becomes clear from FIG. 3 that the connector element 24 carries lateral longitudinal projections 30 and 31 that engage into corresponding channels of the housing profile of the lamella carrier 11 in order to produce a reliable connection between the housing 12 of the lamella carrier 11 and the spacer 10. Catch noses 32 and 33 also contribute thereto, these projecting out of the upper terminating surface 34 of the connector element 24. The front catch nose 32 comprises a slanting, upper terminating surface that runs out toward the terminating surface 34.

A back transverse detent 35 that extends over the entire width of the connector element 24 is provided on the upper terminating surface 34 along the back edge of the fastening element. The catch noses 32 and 33, as well as the back transverse detent 35, are fabricated of the same material as the overall spacer 10.

As shown in FIG. 1, the strip-shaped section 22 of the spacer 10 is introduced from behind into the profiled niche of the lamella carrier 11 in accord with the direction of the arrow 36 when the spacer 10 is clipped to the lamella carrier 11. The lateral longitudinal projections 30 and 31 of the connector element 24 engage into lateral channels of the profiled niche of the lamella carrier 11. Given a stronger pull, the front catch nose 32, which as a consequence of the elasticity of the material, resiliently yields together with the connector element 24, slides over a projection of the profiled niche of the lamella carrier and engages therebehind, whereby the transverse detent 35 is seated against a corresponding detent of the profiled niche.

Figure 5:
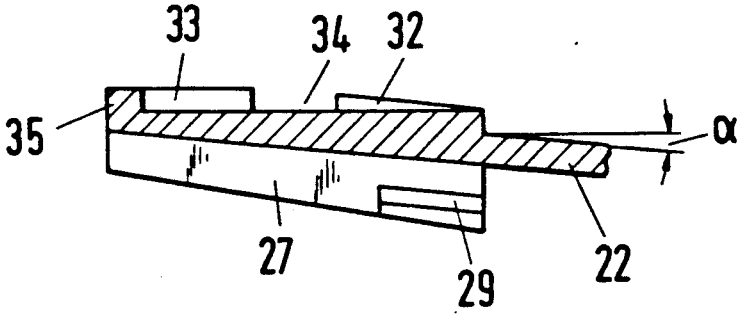
FIG. 5 shows a section through the spacer corresponding to the section line V—V of FIG. 4.

The upper terminating surface 34 of the connector element 24 describes an angle α of about 6° with the longitudinal axis of the strip-shaped section 22, as indicated in FIG. 5. Accordingly, the strip-shaped sections of all spacers lie tightly on one another in imbricated fashion when the lamella carriers are brought together to form a packet. The strip-shaped section of the respectively following spacer thereby slides or, respectively, lies in the channels 37 and 38 of the connector element that are formed by the longitudinal projections 28 and 29.

Let it also be added that the spacer 10 is fashioned such before installation and before being unlatched from the spacer "packet" for better packetization that the individual spacers can be connected in an especially simple way by a slight bending of the connector element 24. For this reason, the arrangement is undertaken such that the principal plane of the connector element 24 proceeds at an acute angle of a few degrees relative to the plane of the strip-shaped section 22.

Let it also be added that the strip-shaped section 22 has its end section that carries the connector element 24 provided with recesses 39 at both of its longitudinal edges and at a distance from this end thereof.

It should be expressly emphasized at this point that the above descriptive merely involves a description of an exemplary character and that various modifications and changes are possible without thereby departing from the framework of the invention. In particular, thus, the profiling of the catch noses 32 and 33 as well as of the back transverse detent 35 can be differently designed whereby the same effect can be achieved.

Although the invention has been described with respect to preferred embodiments, it is not to be so limited as changes and modifications can be made which are within the full intended scope of the invention as defined by the appended claims.

We claim as out invention;

1. A spacer for a lamella carrier for a vertical lamella blind composed of an oblong, elongated, strip-shaped section having a connector element at one end for positive engagement with a lamella carrier and having a detent at the other end, said detent being guidable into seating engagement with a lamella carrier, wherein the connector element of the spacer defines two channels constructed to face away from the lamella carrier, said channels being directed toward one another and their spacing and width essentially corresponding to the dimensions of the strip-shaped section of the spacer, and wherein said connector element includes an upper terminating surface that faces toward the lamella carrier and is inclined relative to the longitudinal axis of the strip-shaped section.

2. A spacer according to claim 1, characterized in that the inclination lies between about 5° and about 10°.

3. A spacer according to claim 2, characterized in that the inclination is about 6°.

4. A spacer for a lamella carrier for a vertical lamella blind composed of an oblong, elongated, strip-shaped section having a connector element at one end for positive engagement with a lamella carrier and having a detent at the other end, said detent being guidable into seating engagement with a lamella carrier, wherein the connector element of the spacer defines two channels constructed to face away from the lamella carrier, said channels being directed toward one another and their spacing and width essentially corresponding to the dimensions of the strip-shaped section of the spacer and wherein said connector includes a base area and inwardly directed projections that are arranged at a distance from the base area of the connector element, are essentially triangular in cross section, and are held at two lateral longitudinal flanges of the connector element.

5. A spacer according to claim 4, characterized in that said channels extend only a partial distance longitudinally of the connector element.

6. A spacer according to claim 5, characterized in that the channels extend only over the front of the connector element toward the detent.

7. A spacer for a lamella carrier for a vertical lamella blind composed of an oblong, elongated, strip-shaped section having a connector element at one end for positive engagement with a lamella carrier and having a detent at the other end, said detent being guidable into seating engagement with a lamella carrier, wherein the connector element of the spacer defines two channels constructed to face away from the lamella carrier, said channels being directed toward one another and their spacing and width essentially corresponding to the dimensions of the strip-shaped section of the spacer and wherein the side edges of the strip-shaped section of the spacer are both provided with bezels.

8. A spacer for a lamella carrier for a vertical lamella blind composed of an oblong, elongated, strip-shaped section having a connector element for positive engagement with a lamella carrier and having a detent at the other end, said detent being guidable into seating engagement with a lamella carrier, wherein the connector element of the spacer defines two channels constructed being to free away from the lamella carrier, said channel directed toward one another and their spacing and width essentially corresponding to the dimensions of the strip-shaped section of the spacer, wherein the element includes an upper terminating surface, lateral longitudinal flanges which extend from the front to the back of the connector, and wherein at least one of the catch noses is limited by an inclined terminating surface.

9. A spacer for a lamella carrier for a vertical lamella blind composed of an oblong, elongated, stripshaped section having a connector element at one end for positive engagement with a lamella carrier and having a detent at the other end, said detent being guidable into seating engagement with a lamella carrier, wherein the connector element of the spacer defines two channels constructed to face away from the lamella carrier, said channels being directed toward one another and their spacing and width essentially corresponding to the dimensions of the strip-shaped section of the spacer and wherein the connector element includes an upper terminating surface which defines a transverse back detent.

10. A spacer according to claim 9, characterized in that the transverse detent extends between the side edges of the connector element.

11. A spacer for a lamella carrier for a vertical lamella blind composed of an oblong, elongated, stripshaped section having a connector element at one end for positive engagement with a lamella carrier and having a detent at the other end, said detent being guidable into seating engagement with a lamella carrier, wherein the connector element of the spacer defines two channels constructed to face away from the lamella carrier, said channels being directed toward one another and their spacing and width essentially corresponding to the dimensions of the strip-shaped section of the spacer and wherein the section of the strip-shaped section that carries the connector element defines an acute angle relative to the strip-shaped section.

12. A spacer according to claim 11, characterized in that the angle described by the connector element and the strip-shaped section amounts to only a few degrees.

13. A spacer for a lamella carrier for a vertical lamella blind composed of an oblong, elongated, strip-shaped section having a connector element at one end for positive engagement with a lamella carrier and having a detent at the other end, said detent being guidable into seating engagement with a lamella carrier, wherein the connector element of the spacer defines two channels constructed to face away from the lamella carrier, said channels being directed toward one another and their spacing and width essentially corresponding to the dimensions of the strip-shaped section of the spacer and in combination therewith, a lamella carrier for a vertical lamella blind which carrier includes means for slidingly engaging a supporting rail, means for supporting and for rotating a vertical lamella blind and means for cooperation with a spacer for spacing said carrier from an adjacent carrier.

* * * * *